US012728344B2

(12) United States Patent
Lawless et al.

(10) Patent No.: US 12,728,344 B2
(45) Date of Patent: Sep. 8, 2026

(54) TOY CONSTRUCTION SET

(71) Applicant: LOVEVERY, INC., Boise, ID (US)

(72) Inventors: Stephen Blaise Lawless, Boise, ID (US); Jacob Douglas Miller, Boise, ID (US)

(73) Assignee: Lovevery, Inc., Boise, ID (US)

( * ) Notice: Subject to any disclaimer, the term of this patent is extended or adjusted under 35 U.S.C. 154(b) by 0 days.

(21) Appl. No.: 19/135,233

(22) PCT Filed: Dec. 5, 2023

(86) PCT No.: PCT/US2023/082546
§ 371 (c)(1),
(2) Date: Jun. 3, 2025

(87) PCT Pub. No.: WO2024/129445
PCT Pub. Date: Jun. 20, 2024

(65) Prior Publication Data

US 2026/0199774 A1 Jul. 16, 2026

Related U.S. Application Data

(60) Provisional application No. 63/432,210, filed on Dec. 13, 2022.

(51) Int. Cl.
*A63F 7/36* (2006.01)

(52) U.S. Cl.
CPC .... *A63F 7/3622* (2013.01); *A63F 2007/3662* (2013.01)

(58) Field of Classification Search
CPC ..... A63F 7/3622; A63F 7/36–3603; A63F 2007/3607–3696
USPC ..... 446/444–447
See application file for complete search history.

(56) References Cited

U.S. PATENT DOCUMENTS 1,828,536 A * 10/1931 Koerber ..... A63H 19/30 104/56
2,838,870 A * 6/1958 Morse ..... A63F 7/3622 446/168
2,919,515 A * 1/1960 Connell ..... A63H 19/30 238/10 R
2,931,131 A * 4/1960 Morse ..... A63F 7/3622 446/168

(Continued)

OTHER PUBLICATIONS

International Preliminary Report on Patentability in International Appln. No. PCT/US2023/082546, mailed on Jun. 26, 2025, 10 pages.

(Continued)

*Primary Examiner* — Michael D Dennis
*Assistant Examiner* — Matthew B Stanczak
(74) *Attorney, Agent, or Firm* — Fish & Richardson P.C.

(57) ABSTRACT

A toy construction set includes an elongated path segment having side surfaces and an upper surface extending between the side surfaces and an elevated path segment support having two spaced-apart legs with inner surfaces facing each other. A shelf extends from the inner surfaces, and the legs define a space of sufficient width above the shelf to receive the elongated path segment. The shelf is configured to support the received elongated path segment in a locally elevated position with the elevated path segment support standing on its legs on a horizontal support surface (128).

16 Claims, 9 Drawing Sheets

(56) References Cited

U.S. PATENT DOCUMENTS 3,225,487 A * 12/1965 Mallalieu ..... A63H 18/02 211/188
3,480,210 A * 11/1969 Perrinjaquet ..... A63F 9/14 238/10 R
3,767,114 A * 10/1973 Rossi ..... A63H 19/30 238/10 E
3,879,039 A * 4/1975 Holden ..... A63F 7/0017 273/110
3,946,516 A * 3/1976 Wirth ..... A63F 7/3622 446/117
4,171,090 A * 10/1979 Eisenburg ..... A63F 7/3622 238/10 R
D290,145 S * 6/1987 Wichman ..... D21/565
4,713,038 A * 12/1987 Wichman ..... A63F 7/3622 446/168
4,767,053 A * 8/1988 Cook ..... A63H 18/028 238/10 F
4,826,076 A * 5/1989 Hesse ..... A63H 18/02 104/126
4,874,342 A * 10/1989 Klitsner ..... A63F 7/3622 446/168
4,932,917 A * 6/1990 Klitsner ..... A63F 7/3622 446/168
5,007,876 A * 4/1991 Klitsner ..... A63F 7/3622 446/168
D327,518 S * 6/1992 Pagel ..... D21/502
5,451,177 A * 9/1995 Gilman ..... A63F 7/3622 446/128
5,456,410 A * 10/1995 Chow ..... A63H 18/02 104/126
5,709,581 A * 1/1998 Rothbarth ..... A63F 7/3622 446/171
5,779,145 A * 7/1998 Zelle ..... A63H 19/30 238/10 F
5,785,573 A * 7/1998 Rothbarth ..... A63F 7/3622 446/171
5,873,521 A * 2/1999 Ernst ..... A63H 18/00 104/126
6,009,812 A * 1/2000 Ernst ..... A63H 18/00 238/10 R
6,074,269 A * 6/2000 Rothbarth ..... A63F 7/3622 446/268
6,340,323 B1 * 1/2002 Glynn ..... A63H 33/042 40/406
6,536,763 B1 * 3/2003 Braun ..... A63F 7/3622 273/123 R
6,647,893 B1 * 11/2003 Fugitt ..... A63H 18/028 104/126
6,783,419 B1 * 8/2004 Paukert ..... A63H 18/02 446/444
8,113,122 B2 * 2/2012 Tarr ..... A63H 19/34 238/10 E
8,475,226 B2 * 7/2013 Comfort ..... A63H 18/00 446/168
8,776,695 B2 * 7/2014 Ho ..... A63H 19/30 104/124
D723,108 S * 2/2015 Schutt ..... D21/484
9,120,028 B2 * 9/2015 Wilson ..... A63H 19/30
9,409,097 B2 * 8/2016 Comfort ..... A63H 18/02
9,956,493 B1 * 5/2018 Hunts, Jr. ..... A63H 33/046
10,046,246 B2 * 8/2018 Muldoon ..... A63H 19/34
10,086,305 B2 * 10/2018 Juliano ..... A63H 19/30
10,653,970 B2 * 5/2020 Forgrave ..... A63F 7/3075
10,843,095 B2 * 11/2020 Paperno ..... A63H 18/02
10,918,963 B2 * 2/2021 Ornstein ..... A63H 33/06
10,953,339 B1 * 3/2021 Liu ..... A63H 33/046
11,045,740 B2 * 6/2021 Wang ..... A63H 33/26
11,426,672 B1 * 8/2022 Hwang ..... A63H 18/026
11,439,894 B2 * 9/2022 Stringham ..... A63F 7/28
11,779,853 B2 * 10/2023 Forgrave ..... A63F 7/3622 446/122
11,951,411 B2 * 4/2024 Forgrave ..... A63H 33/08
2007/0259600 A1 * 11/2007 Bedford ..... A63H 21/04 446/444
2009/0084863 A1 * 4/2009 Sorenson ..... A63F 7/3622 238/122
2016/0236109 A1 * 8/2016 Juliano ..... A63H 19/30
2019/0001232 A1 * 1/2019 Forgrave ..... A63H 33/08
2019/0255451 A1 * 8/2019 Paperno ..... A63H 18/02
2020/0054954 A1 * 2/2020 Forgrave ..... A63F 7/3622
2022/0032170 A1 * 2/2022 Stringham ..... A63F 7/28
2023/0120706 A1 * 4/2023 Forgrave ..... A63H 18/02 446/122
2024/0207750 A1 * 6/2024 Luo ..... A63H 18/06
2026/0097299 A1 * 4/2026 Forgrave ..... A63F 7/3622

OTHER PUBLICATIONS

International Search Report and Written Opinion in International Appln. No. PCT/US2023/082546, mailed on Apr. 2, 2024, 16 pages.

* cited by examiner

TOY CONSTRUCTION SET

CROSS-REFERENCE TO RELATED APPLICATIONS

This application is a National Stage Application under 35 U.S.C. § 371 and claims the benefit of International Application No. PCT/US2023/082546, filed Dec. 5, 2023, which claims priority to U.S. Provisional Patent Application No. 63/432,210, filed Dec. 13, 2022. The entire contents of the foregoing are hereby incorporated by reference.

TECHNICAL FIELD

This invention relates to toy construction sets, and more particularly to toy construction sets having a ball and a track set including a ramp.

BACKGROUND

Children (e.g., infants and toddlers) can benefit from playing with tracking toys and construction toys. Tracking toys can be designed to facilitate children to learn to grasp and release objects with their hands, visually track objects, as well as to develop prediction and early logic skills. Additionally, tracking toys can be designed to facilitate an improvement in children's concentration skills and can help introduce them to an object that performs with gravity. Tracking and construction toys can be designed to develop a combination of gross and fine motor skills and to promote hand-eye coordination, spatial reasoning, cognitive flexibility, problem-solving, creativity, divergent thinking, language skills, and social competence. Thus, improvements in the design, configuration, and safety of such toys are continually sought.

SUMMARY

In general, this disclosure relates to toy construction sets that include a tracking aspect. For example, the toy construction sets of the disclosure include a ball and one or more path segments that can form a ramp and are configured to be supported by one or more elevated path segment supports.

In one aspect, the present disclosure features a toy construction set including: an elongated path segment having side surfaces and an upper surface extending between the side surfaces, the path segment having orthogonal overall dimensions of length, width and thickness, with the length being greater than the width, which is greater than the thickness, the width being a distance between the side surfaces; and an elevated path segment support having two spaced-apart legs with inner surfaces facing each other, and a shelf extending from the inner surfaces, the legs defining a space therebetween of sufficient width above the shelf to receive the elongated path segment therein, the shelf being configured to support the received elongated path segment in a locally elevated position with the elevated path segment support standing on its legs on a horizontal support surface, wherein the inner surfaces of the legs are convex in a region of each leg above the shelf, and wherein the inner surfaces of the legs are arranged with respect to the width of the elongated path segment such that rotating the elevated path segment support with respect to the elongated path segment with the elongated path segment received between the inner surfaces of the legs will cause the inner surfaces of the legs to bear against the side surfaces of the elongated path segment to brace the elongated path segment against the elevated path segment support within 30 degrees of elevated path segment support rotation from an orientation perpendicular to the elongated path segment.

In some embodiments, the elevated path segment support has a handle connecting the legs.

In some embodiments, the handle has a rounded, inverted U-shape.

In some embodiments, the elevated path segment support further includes a wing extending outwardly from the inner surface of each leg in the region of each leg above the shelf.

In some embodiments, each leg of the elevated path segment has an outer surface that is concave.

In some embodiments, the outer surface of each leg defines a groove.

In some embodiments, the elevated path segment support further includes a ridge extending outwardly from the inner surface of each leg in a region of each leg below the shelf.

In some embodiments, the toy construction set further includes a second elevated path segment support, wherein the elevated path segment support is a first elevated path segment support, and wherein the ridge of the first elevated path segment support is configured to connect with a groove of the second elevated path segment support such that the first elevated path segment support is stackable with the second elevated path segment support.

In some embodiments, the toy construction set further includes a winding path segment configured to releasably couple to the elongated path segment via a connector.

In some embodiments, the toy construction set further includes one or more container attachments having a base defining an opening therethrough, the one or more container attachments configured to releasably couple to an end of the elongated path segment or an end of the winding path segment.

In some embodiments, the toy construction set further includes a curved path attachment configured to releasably couple to an end of the elongated path segment or an end of the winding path segment.

In some embodiments, the toy construction set further includes a toy configured to contact and travel on the upper surface of the elongated path segment.

In some embodiments, the toy is one or more of a ball, a marble, a toy vehicle, a disk, a toy wheel, or a ring.

Another aspect of the present disclosure features a method of assembling a toy construction set. The method includes stacking a first elevated path segment support onto a second elevated path segment support, each of the first and second elevated path segment supports having two spaced-apart legs with inner surfaces facing each other, and a shelf extending from the inner surfaces, wherein the stacking includes connecting two first grooves, each of the grooves defined by an outer surface of each leg of the first elevated path segment support, to two second ridges extending outwardly from the inner surface of each leg of the second elevated path segment support; inserting an elongated path segment above the shelf of the first or second elevated path segment supports, in a space of sufficient width defined between the legs such that a portion of the elongated path segment rests on the shelf, and rotating the first or second elevated path segment support that is supporting the elongated path segment with respect to the elongated path segment, thereby securing the elongated path segment.

In some embodiments, the elongated path segment has side surfaces and an upper surface extending between the side surfaces.

In some embodiments, the path segment has orthogonal overall dimensions of length, width and thickness, with the length being greater than the width, which is greater than the thickness, the width being a distance between the side surfaces.

In some embodiments, securing the elongated path segment includes receiving the elongated path segment between the inner surfaces of the legs, thereby causing the inner surfaces of the legs to bear against the side surfaces of the elongated path segment to brace the elongated path segment against the elevated path segment support.

In some embodiments, the elongated path segment braces the elongated path segment against the elevated path segment support within 30 degrees of elevated path segment support rotation from an orientation perpendicular to the elevated path segment.

In some embodiments, the second ridges extending outwardly from the inner surface of each leg in a region of each leg below the shelf.

In some embodiments, the method further includes releasably coupling one or more of a winding path segment, a container attachments, or a curved path attachment to an end of the elongated path segment.

Embodiments may provide one or more of the following advantages.

Various embodiments of the present disclosure relate to toy construction sets preferably intended for use by children (e.g., toddlers and/or preschoolers). In some embodiments, the toy construction sets of the disclosure may advantageously combine construction and tracking aspects into a single toy set. Thus, in some embodiments, the toy construction sets of the disclosure may provide a combination of benefits that would otherwise require two separate, different toy sets. For example, in some embodiments, these benefits may include but are not limited to facilitating children to learn to grasp and release objects with their hands, to visually track objects, to improve concentration skills, and to develop prediction skills, early logic skills, gross and fine motor skills, hand-eye coordination, spatial reasoning, cognitive flexibility, problem-solving, creativity, divergent thinking, language skills, and/or social competence.

In some embodiments, the toy construction sets of the disclosure include one or more modular components that can be assembled and/or arranged in different configurations, thereby offering the user flexibility to build various toy set-ups. For example, the toy construction set of the disclosure can include one or more path segments and one or more path attachments that are configured to be coupled to each other via one or more connectors, thereby enabling the user to build various path configurations.

Furthermore, the toy construction sets of the disclosure include one or more elevated path segment supports that are stackable, thereby the toy construction sets may allow the user to vary the height and incline of a ramp or track composed of one or more path segments. In addition, the toy construction sets of the disclosure include one or more elevated path segment supports that are self-standing and are configured to support one or more path segments in a selected configuration. Various aspects of the supports and associated ramps allow for enhanced track stability while permitting easy assembly through clearances between mating components.

In some embodiments, the toy construction sets of the disclosure may teach cause and effect to a child (e.g., a toddler or a preschooler) that plays or uses the toy construction sets. In some embodiments, the toy construction sets described herein may teach the child that their environment can change as a result of their actions. For example, the ball can roll down the ramp and land within a container as a result of the child placing the ball on an elevated portion of the ramp. In a related manner, the toy construction sets of the disclosure may also teach basic physics principles such as, potential energy, kinetic energy, magnitude and trajectory of a mass (e.g., ballistics, when using a curved path attachment as a launching ramp).

The details of one or more embodiments of the invention are set forth in the accompanying drawings and the description below. Other features, objects, and advantages of the invention will be apparent from the description and drawings, and from the claims.

Where values are described in terms of ranges, it should be understood that the description includes the disclosure of all possible sub-ranges within such ranges, as well as specific numerical values that fall within such ranges irrespective of whether a specific numerical value or specific sub-range is expressly stated. Further, the term "about," when used in connection with a referenced numeric value, is intended to include the referenced numeric value plus or minus up to 10% of that referenced numeric value, including increments therein. For example, the language "about 50" covers the range of 45 to 55.

The term "each," when used in reference to a collection of items, is intended to identify an individual item in the collection but does not necessarily refer to every item in the collection, unless expressly stated otherwise, or unless the context of the usage clearly indicates otherwise.

The singular form "a," "an," and "the" include plural references unless the context clearly dictates otherwise. The term "and/or" (e.g., "A and/or B") is used herein to include all of the following alternatives: "A," "B," "A or B," and "A and B."

DESCRIPTION OF DRAWINGS

Like reference symbols in the various drawings indicate like elements.

DETAILED DESCRIPTION

Figure 1:
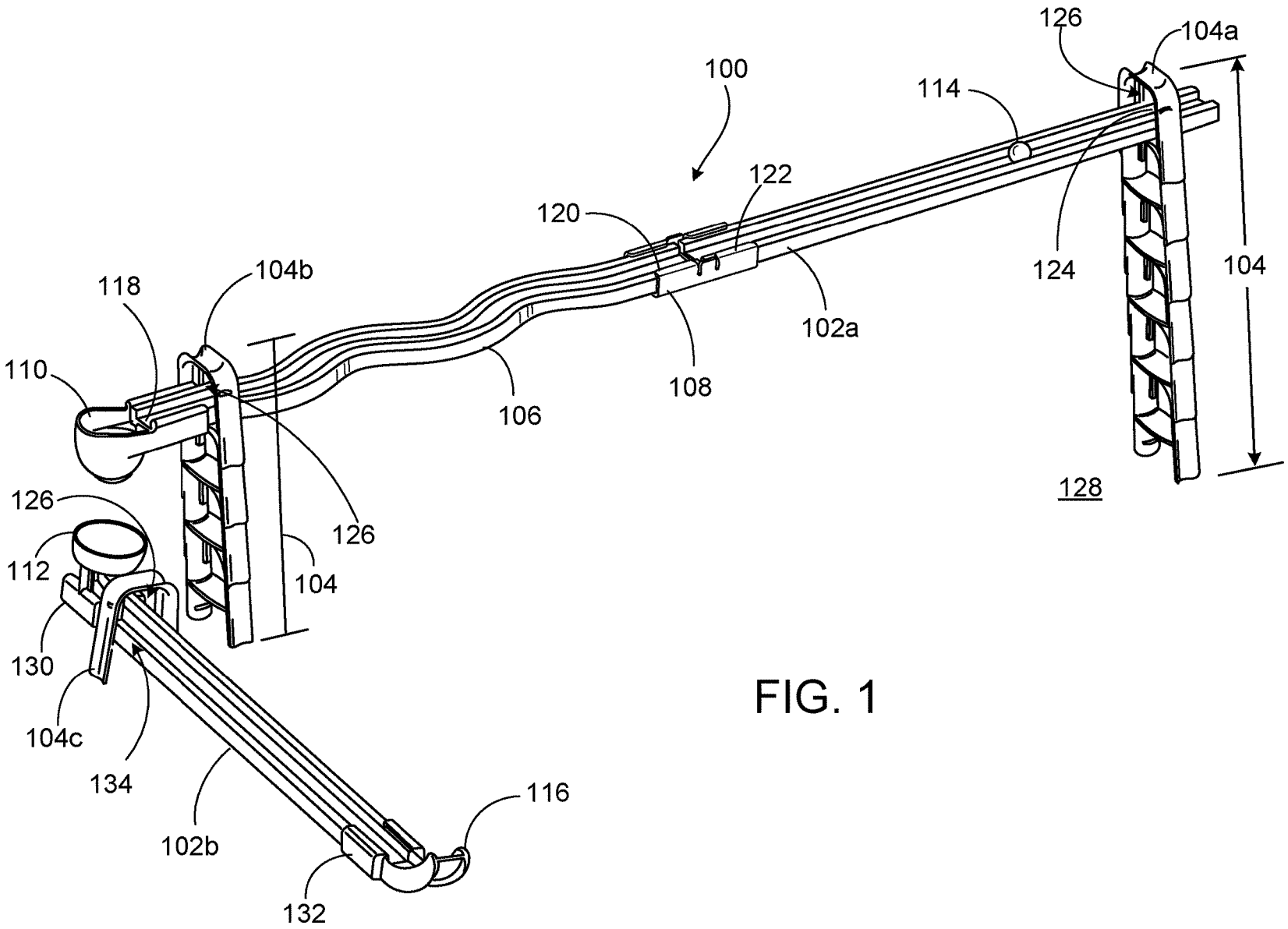
FIG. 1 is a perspective view of an example toy construction set in an assembled state.

FIG. 1 illustrates a toy construction set 100 that can be used by children (e.g., toddlers and/or preschoolers) for play and/or educational purposes. The toy construction set 100 includes a pair of elongated path segments 102 and a winding path segment 106 that are configured to receive a ball 114 and are configured to be releasably coupled via a connector 108. The toy construction set 100 includes a plurality of identically sized and shaped elevated path segment supports 104, which are configured to support the pair of elongated path segments 102 and the winding path segment 106. A first container attachment 110, a second container attachment 112, and a curved path attachment 116 are configured to be attached to an elongated path segment 102 and/or the winding path segment 106.

As shown in FIG. 1, an example set-up of the toy construction set 100 includes the connector 108 releasably coupling a distal end 120 of the winding path segment 106 with a proximal end 122 of the first elongated path segment 102*a*. The distal end 124 of the first elongated path segment 102*a* and the proximal end 118 of the winding path segment 106 are received within a space 126 defined by an elevated path segment support 104. A total of six elevated path segment supports 104 are in a vertically stacked arrangement and the first elevated path segment support 104*a*, which is the uppermost elevated path segment support 104 relative to the horizontal support surface 128, receives the distal end 124 of the first elongated path segment 102*a* within the space 126 defined by the first elevated path segment support 104*a*. A total of four elevated path segment supports 104 are in a vertically stacked arrangement disposed in a direction opposite to and directly across from the stack of six elevated path segment supports 104 supporting the distal end 124 of the first elongated path segment 102*a*. The second elevated path segment support 104*b*, which is the uppermost elevated path segment support 104 relative to the horizontal support surface 128 in the stack of four elevated path segment supports 104, receives the proximal end 118 of the winding path segment 106 within the space 126 defined by the second elevated path segment support 104*b*. Thus, the distal end 124 of the first elongated path segment 102*a* is elevated with respect to the proximal end 118 of the winding path segment 106, thereby creating a ramp having an elongated portion and a winding portion.

The first container attachment 110 defines an opening at its base and is releasably coupled to the proximal end 118 of the winding path segment 106. The second container attachment 112 also defines an opening at its base and is aligned with and positioned directly below the first container attachment 110. Thus, the ball 114 is configured to travel through the opening of the first container attachment 110 and subsequently through the opening of the second container attachment 112 in order to contact a surface of the second elongated path segment 102*b* and continue its travel. The second container attachment 112 is releasably coupled to the distal end 130 of the second elongated path segment 102*b*, which is disposed on and supported by the horizontal support surface 128. A distal end portion 134 of the second elongated path segment 102*b* is received by the third elevated path segment support 104*c*, within the space 126 defined by the third elevated path segment support 104*c*. The third elevated path segment support 104*c* is disposed proximal to the second container attachment 112. The curved path attachment 116 is releasably coupled to the proximal end 132 of the second elongated path segment 102*b*.

The elongated path segment 102, the elevated path segment support 104, the winding path segment 106, the connector 108, the first container attachment 110, the first container attachment 110, and the curved path attachment 116 are typically made of one or more rigid materials. Example materials from which the elongated path segment 102 and the winding path segment 106 may be made include wood (e.g., birch plywood) or plastic. The ball 114 are typically made of one or more rigid materials but can also be made of one or more rubbery materials. Example materials from which the ball 114 may be made include wood (e.g., birch plywood), plastic, rubber, or glass.

The ball 114 is configured to contact and travel on an upper surface of the elongated path segment. In some embodiments, a toy is configured to contact and travel on an upper surface of the elongated path segment. In some embodiments, the toy is one or more of a ball, a marble, a toy vehicle, a disk, a toy wheel, or a ring.

Figure 2:
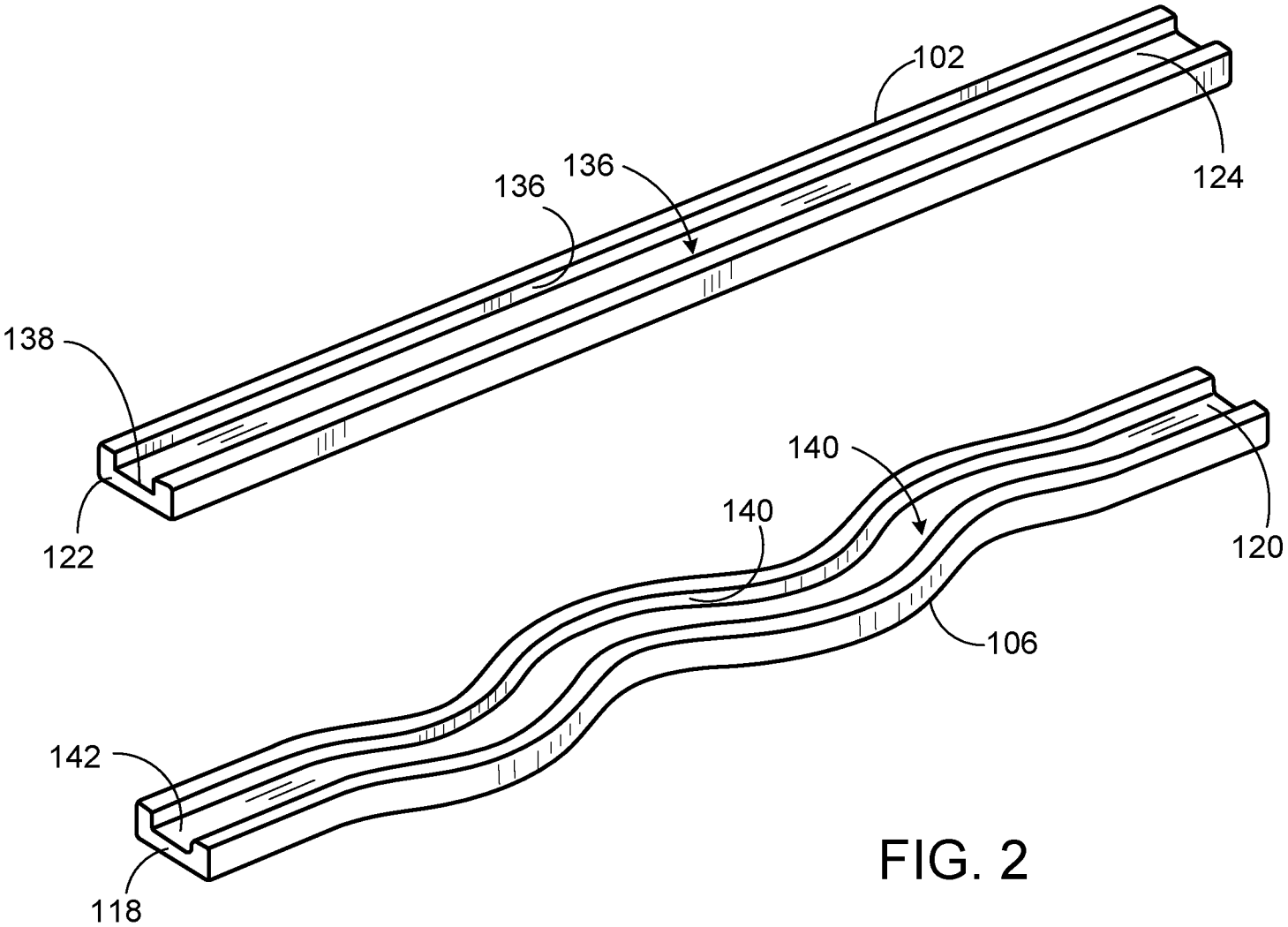
FIG. 2 is a perspective view of an elongated path segment and a winding path segment of the toy construction set of FIG. 1.

Referring to FIG. 2, the elongated path segment 102 has a pair of opposing, inner side surfaces 136 and an upper surface 138 extending widthwise between the inner side surfaces 136 and extending lengthwise between the proximal end 122 and distal end 124. The elongated path segment 102 has orthogonal overall dimensions of length, width, and thickness. The width of the elongated path segment 102 is defined as a distance between the inner side surfaces 136, and the length of the elongated path segment 102 is defined as a distance between the proximal end 122 and distal end 124. The length of the elongated path segment 102 is greater than the width of the elongated path segment 102, which is greater than the thickness of the elongated path segment 102.

The winding path segment 106 has a pair of opposing, inner side surfaces 140 and an upper surface 142 extending widthwise between the inner side surfaces 140 and extending lengthwise in a winding path between the proximal end 118 and distal end 120. The winding path segment 106 has a winding shape including several curves. The width of the winding path segment 106 is defined as a distance between the inner side surfaces 140, and the length of the winding path segment 106 is defined as a distance between the proximal end 118 and distal end 120. The length of the winding path segment 106 is greater than the width of the winding path segment 106, which is greater than the thickness of the winding path segment 106.

The width, length, and thickness of the winding path segment 106 are about the same as the width, length, and thickness, respectively, of the elongated path segment 102. However, the winding path segment 106 and the elongated path segment 102 may have any suitable width, length, and thickness, which can be about equivalent to each other or can differ. For example, the winding path segment 106 and the elongated path segment 102 may have about equivalent widths, about equivalent lengths, and/or about equivalent thicknesses. In another example, the winding path segment 106 and the elongated path segment 102 may have different widths, different lengths, and/or different thicknesses.

Referring to FIGS. 3-7, an elevated path segment support 104 includes two spaced-apart legs 144 with inner surfaces 146 facing each other and with outer surfaces 152 facing away from each other, on opposing sides of the inner surfaces 146. The elevated path segment support 104 further includes a shelf 148 extending from the inner surfaces 146. The shelf 148 is integrally connected to the legs 144. As briefly described above, the space 126 is defined between the legs 144. The space 126 above the shelf 148 has a sufficient width to receive the elongated path segment 102. Thus, the shelf 148 is configured to support the received elongated path segment 102 in a locally elevated position with the elevated path segment support 104 standing on its legs 144 on a horizontal support surface 128.

The inner surfaces 146 of the legs 144 are convex in a region 150 of each leg 144 above the shelf 148 and in a region 151 of each leg 144 below the shelf 148. The inner surfaces 146 that are convex in the region 150 are configured to abut the side edges of the elongated path segment 102 or the winding path segment 106 when in an assembled state (e.g., when the elongated path segment 102 or the winding path segment 106 when in an assembled state is received and/or supported by the elevated path segment support 104).

The elevated path segment support 104 further includes a pair of ridges 162, each ridge 162 extending outwardly or protruding from the inner surface 146 of each leg 144 in the region 151 of each leg 144 below the shelf 148. Each ridge 162 of the pair of ridges 162 is about equivalent in size and shape to each other. Each ridge 162 has a horizontal shape and has a relatively abrupt convexity or protuberance on the inner surface 146 of each leg 144.

Furthermore, the outer surfaces 152 of the legs 144 are concave in a region 160 of each leg 144 that extends substantially throughout its height. Each outer surface 152 of the legs 144 defines a groove 164 having a sunken area or indenture with a horizontal shape that is configured to interact with and releasably couple to the ridge 162 of an additional elevated path segment support 104. For example, the ridge 162 of a first elevated path segment support is configured to connect with a groove 164 of a second elevated path segment support such that the first elevated path segment support is stackable with the second elevated path segment support. In this manner, a plurality of elevated path segment supports are configured to be stacked onto each other as shown in FIG. 1. The ridges 162 and grooves 164 may have any suitable shape and size that is configured to releasably engage with one another.

Figure 3:
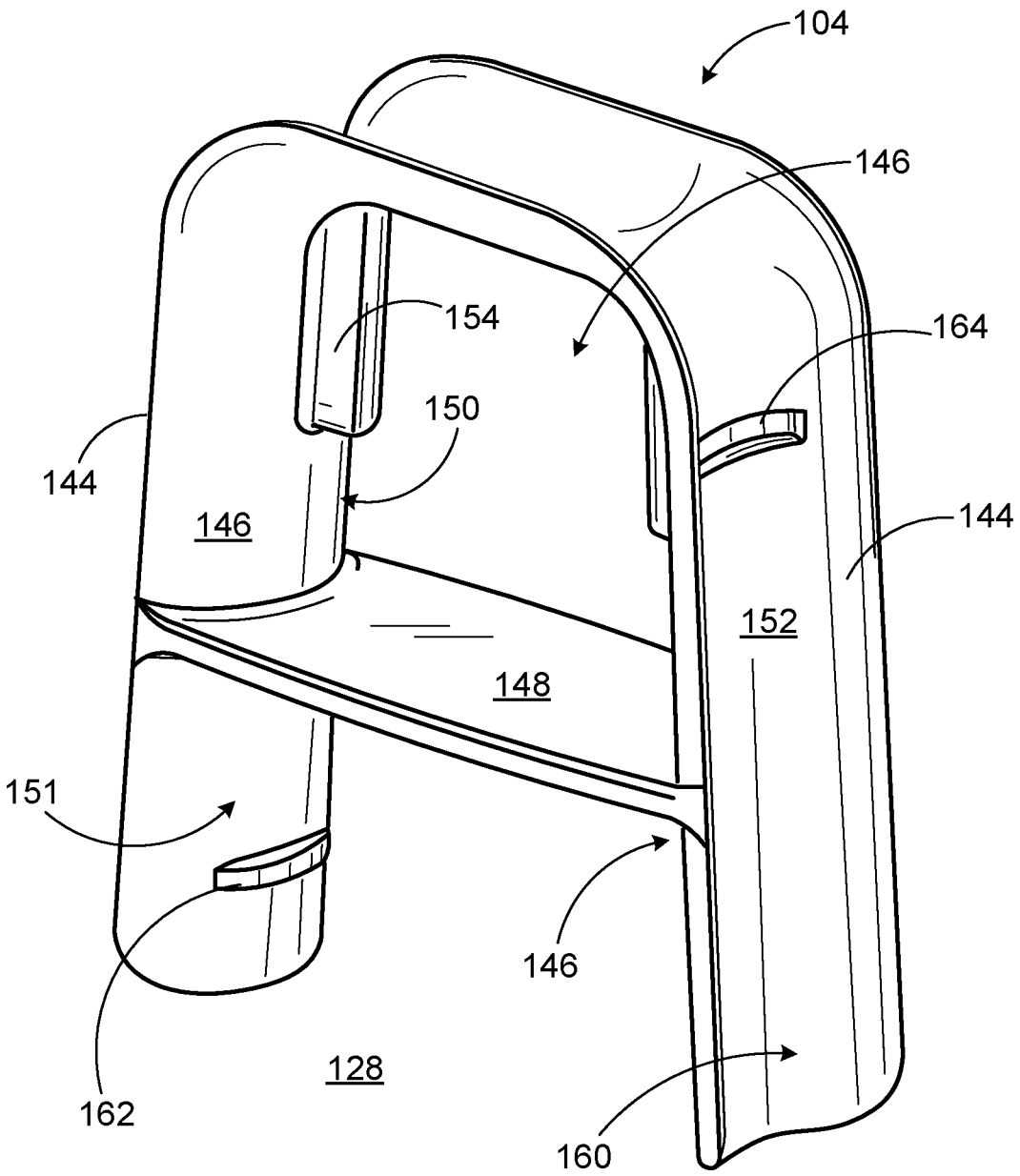
FIG. 3 is a perspective view of an elevated path segment support of the toy construction set of FIG. 1.
Figure 4:
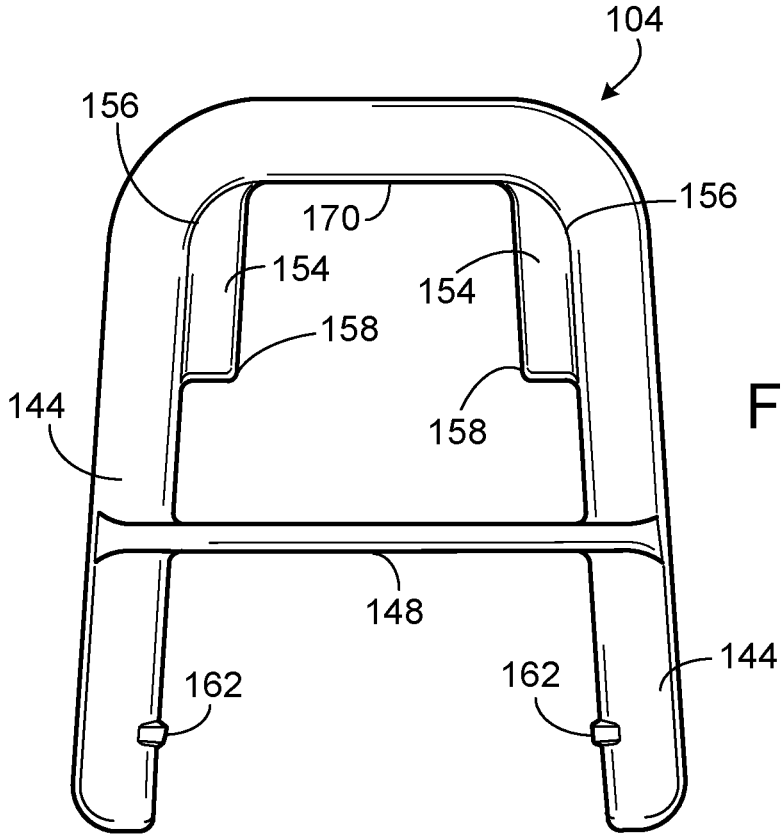
FIG. 4 is a front view of the elevated path segment support of FIG. 3.
Figure 5:
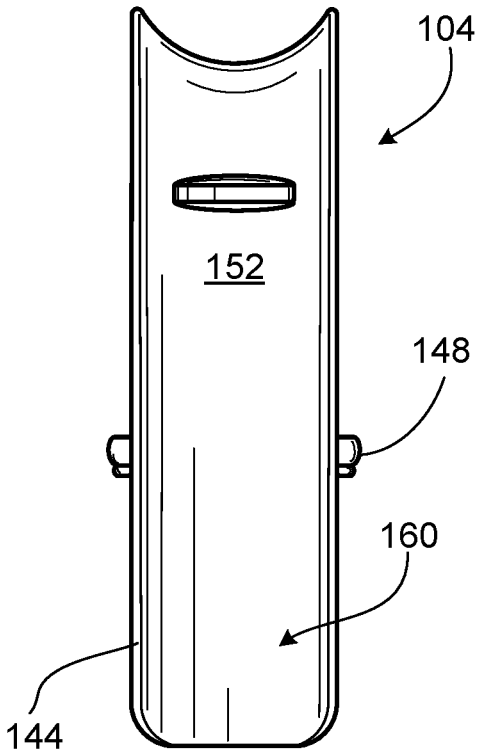
FIG. 5 is a side view of the elevated path segment support of FIG. 3.

Referring particularly to FIGS. 3 and 4, the elevated path segment support 104 further includes a pair of wings 154, each of the pair of wings 154 extends outwardly from the inner surface 146 of each leg 144 in the region 150 of each leg 144 above the shelf 148. As shown in FIG. 4, each wing 154 has a curved edge 156 that is integrally connected to the elevated path segment support 104 and an opposing, orthogonal edge 158 that is configured to contact a portion of the elongated path segment 102 or the winding path segment 106 when in an assembled state (e.g., when the elongated path segment 102 or the winding path segment 106 when in an assembled state is received and/or supported by the elevated path segment support 104). The orthogonal edge 158 of each wing 154 is configured to help secure the elongated path segment 102 in place when the elevated path segment support 104 is rotated with respect to the elongated path segment 102 or the winding path segment 106 when in an assembled state by causing the upper edges of the side surfaces of the elongated path segment 102 or the winding path segment 106 to bear against the orthogonal edges 158.

Figure 6:
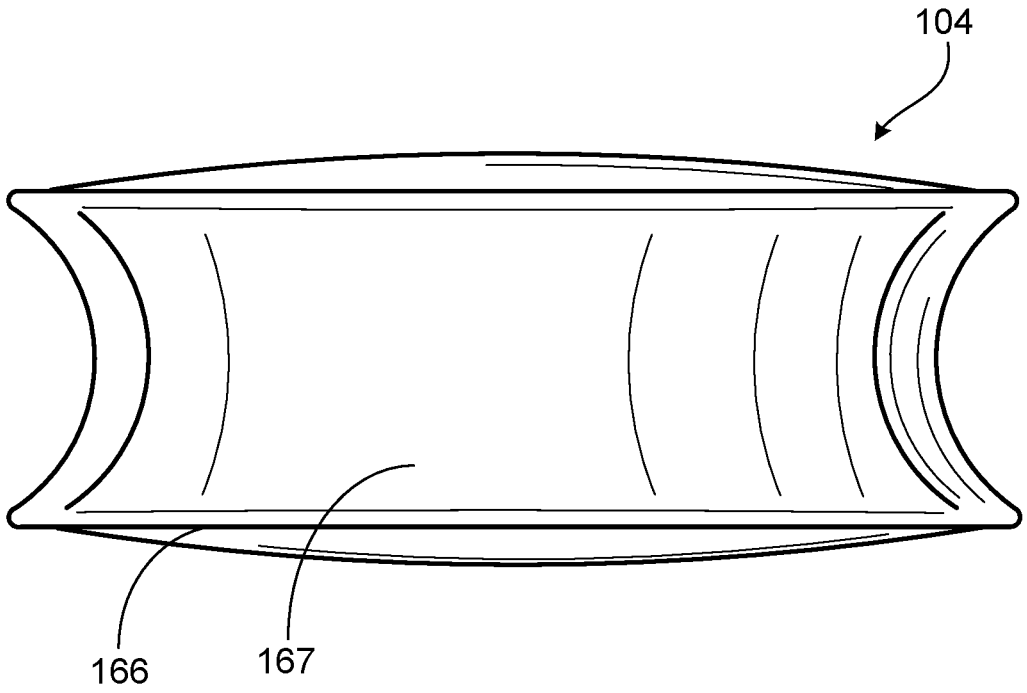
FIG. 6 is a top view of the elevated path segment support of FIG. 3.
Figure 7:
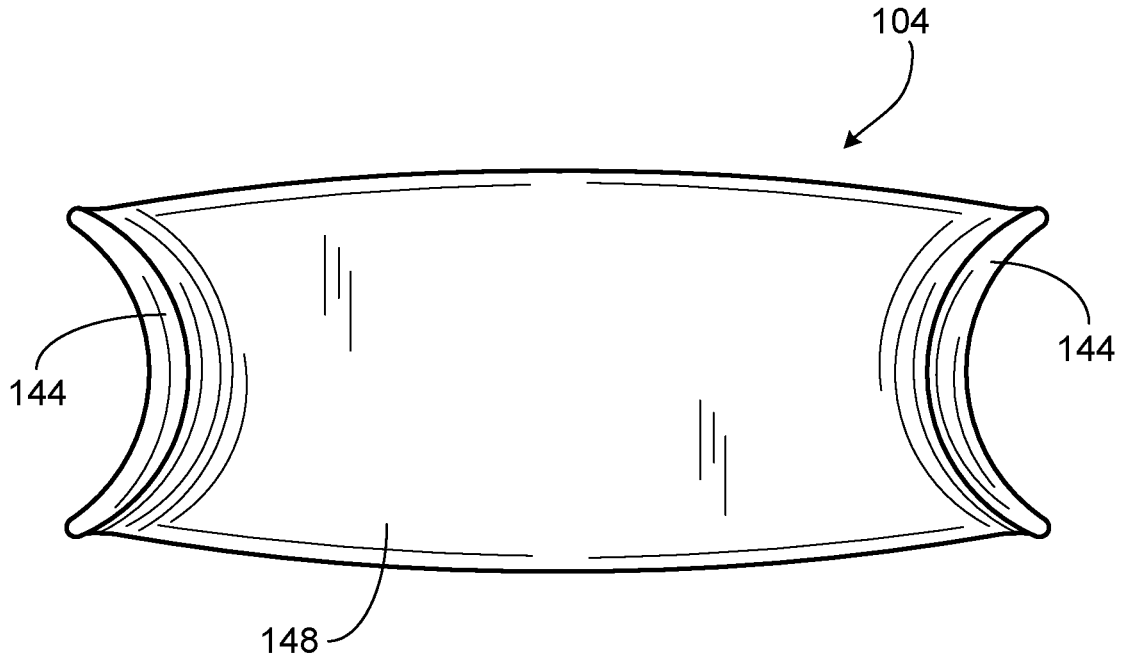
FIG. 7 is a bottom view of the elevated path segment support of FIG. 3.

Referring particularly to FIGS. 4 and 6, the elevated path segment support 104 has a handle 166 connecting the legs 144. The handle 166 is integrally connected to the legs 144 and has a rounded, inverted U-shape. However, the handle 166 may have any suitable shape (e.g., a square shape). The handle 166 has an outer surface 167 that is concave and an inner surface 170 that is convex. When in a stacked configuration, the outer surface 167 of a handle 166 of a first elevated path segment support is configured to receive the inner surface 170 of a handle 166 of a second elevated path segment support.

When assembling one or more components of a toy construction set, one of the steps includes stacking a first elevated path segment support onto a second elevated path segment support. The stacking step includes connecting two first grooves 164 from the first elevated path segment support to two second ridges 162 extending outwardly away from the inner surface of each leg of the second elevated path segment support, as described previously. Next, another step during the assembly process includes inserting an elongated path segment or a winding path segment above the shelf 148 of the first or second elevated path segment supports such that a portion of the elongated path segment rests on the shelf, as described above. Then, the first or second elevated path segment support that is supporting the elongated path segment is rotated with respect to the elongated path segment, thereby securing the elongated path segment. One or more of a container attachment or a curved path attachment can also be releasably coupled to an end of the elongated path segment.

Figure 8:
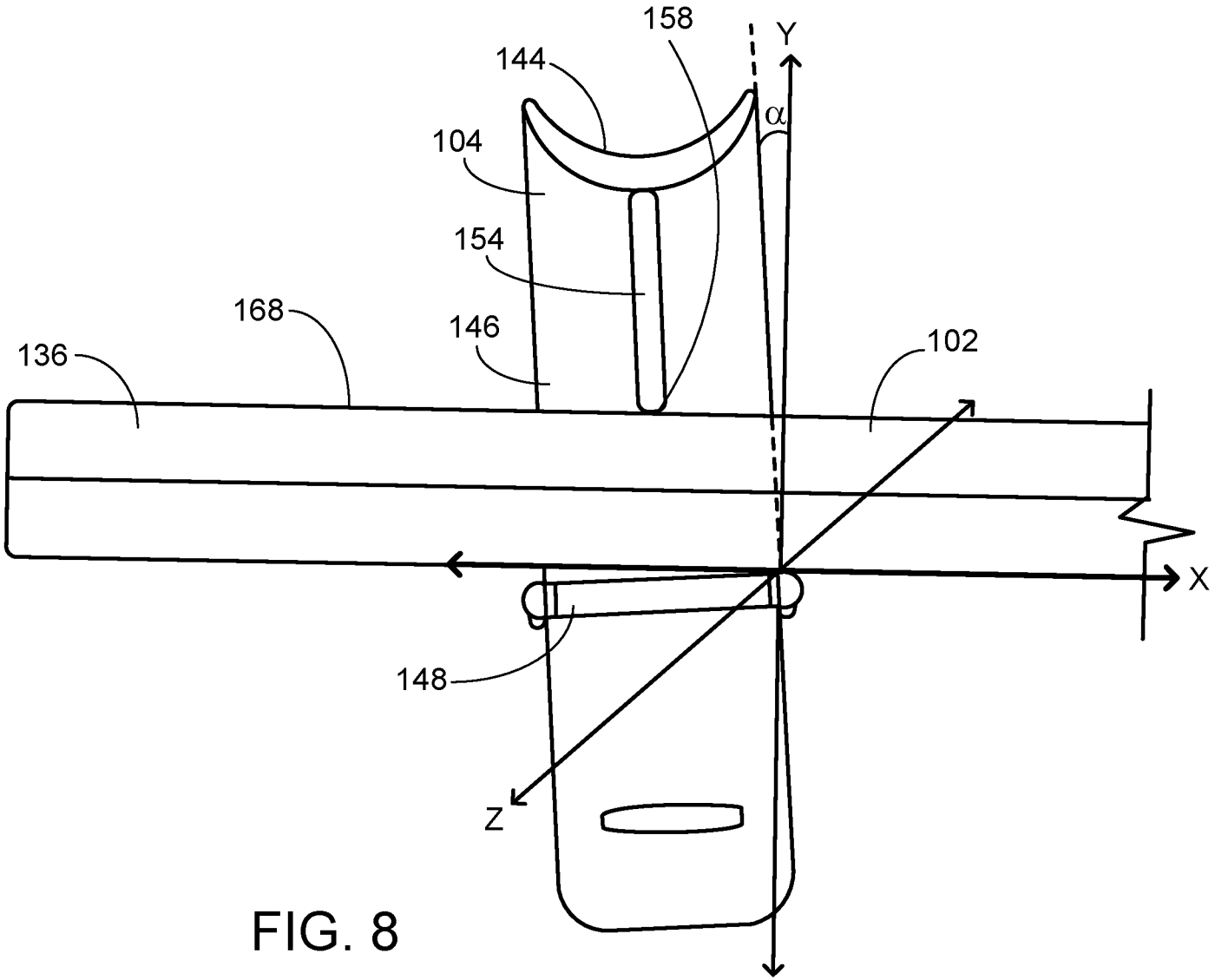
FIG. 8 is a side cross-sectional view of the elevated path segment support of FIG. 3 receiving an elongated path segment.
Figure 9:
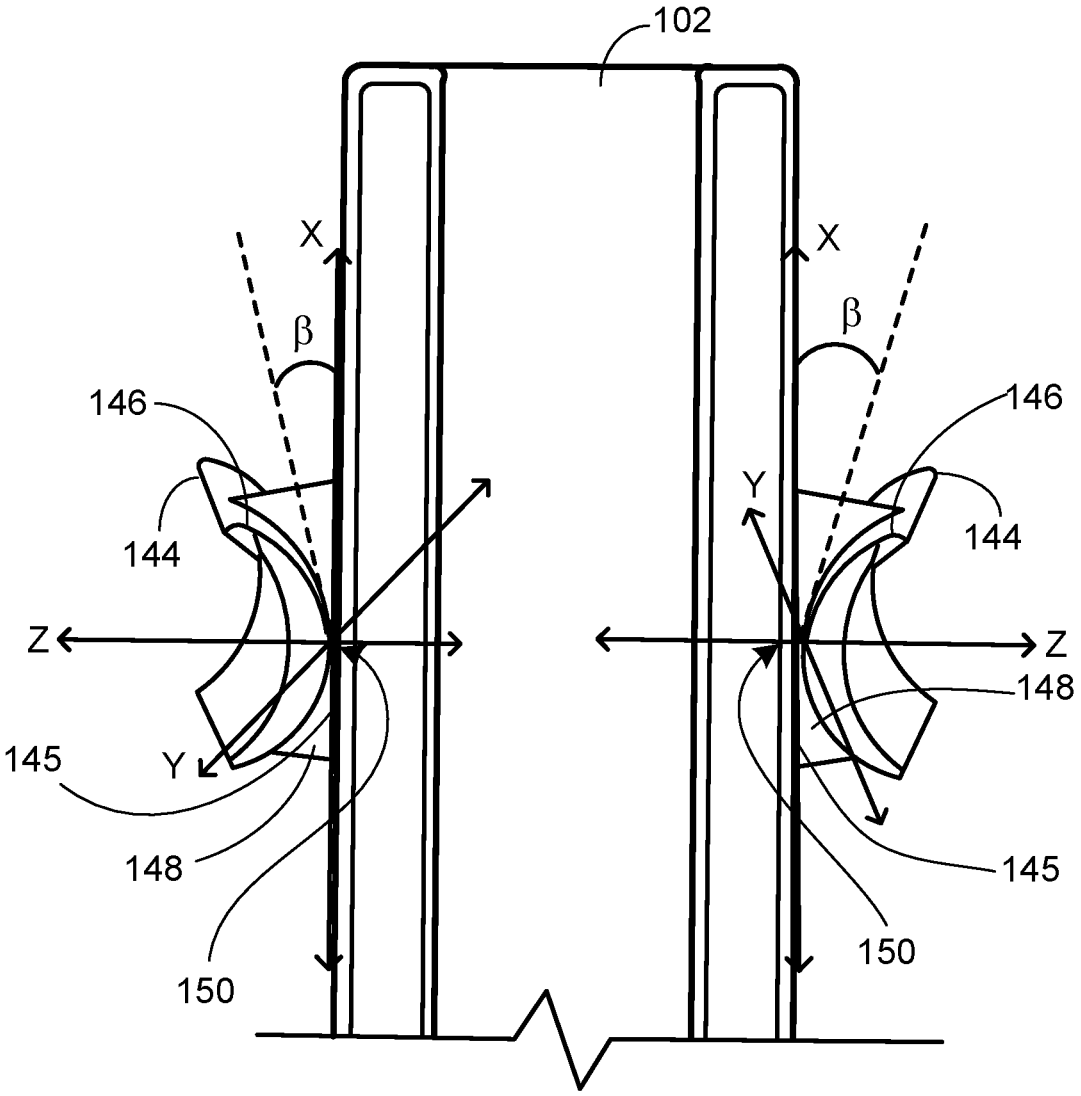
FIG. 9 is a top cross-sectional view of the elevated path segment support of FIG. 3 receiving an elongated path segment.

Referring to FIGS. 8 and 9, FIG. 8 illustrates a side cross-sectional view of the elevated path segment support 104 receiving the elongated path segment 102 between the inner surfaces of the legs 144, and FIG. 9 illustrates a top cross-sectional view of the same. The elongated path segment 102 can be secured in place by rotating the elevated path segment support 104 with respect to the elongated path segment 102 in a first and/or second directions: i) about a horizontal axis defined by a length of the elongated path segment 102 (e.g., the X-axis shown in FIGS. 8 and 9), and ii) about a vertical axis that is transverse to the horizontal axis and defined by a height of the elevated path segment support 104 (e.g., the Y-axis shown in FIGS. 8 and 9). As shown in FIG. 9, the inner surfaces 146 of the legs 144 are arranged with respect to the width of the elongated path segment 102 such that rotating the elevated path segment support 104 with respect to the elongated path segment 102 about the vertical axis (e.g., the Y-axis), in a twisting motion either to the right or left with respect to the elongated path segment 102, such that the elongated path segment 102 is at an angle beta ($\beta$) with respect to the horizontal axis (e.g., the X-axis), causes the inner surfaces 146 of the legs 144, specifically the convex region 150 above the shelf 148, to bear against the outer side surfaces 145 of the elongated path segment 102, thereby securing the elongated path segment 102 in place. The angle beta ($\beta$) is about 30 degrees or less. In some embodiments, the angle beta ($\beta$) can range from about 1 degree to about 30 degrees. This, in turn, can cause the inner surfaces 146 of the legs 144 to brace the elongated path segment 102 against the elevated path segment support 104 within an angle alpha ($\alpha$) of elevated path segment support rotation from an orientation perpendicular to the elongated path segment 102, as shown in FIG. 8. The angle alpha is about 30 degrees or less. In some embodiments, the angle alpha ($\alpha$) can range from about 1 degree to about 30 degrees. Furthermore, rotating the elevated path segment support 104 with respect to the elongated path segment 102, about the horizontal axis (e.g., the X-axis), such that the elongated path segment 102 is at an angle alpha ($\alpha$) with respect to the vertical axis (e.g., the Y-axis), causes the upper edge 168 of the inner side surface 136 of the elongated path segment 102 to bear against the orthogonal edge 158 of each wing 154, thereby securing the elongated path segment 102 in place, within the elevated path segment support 104.

Figure 10:
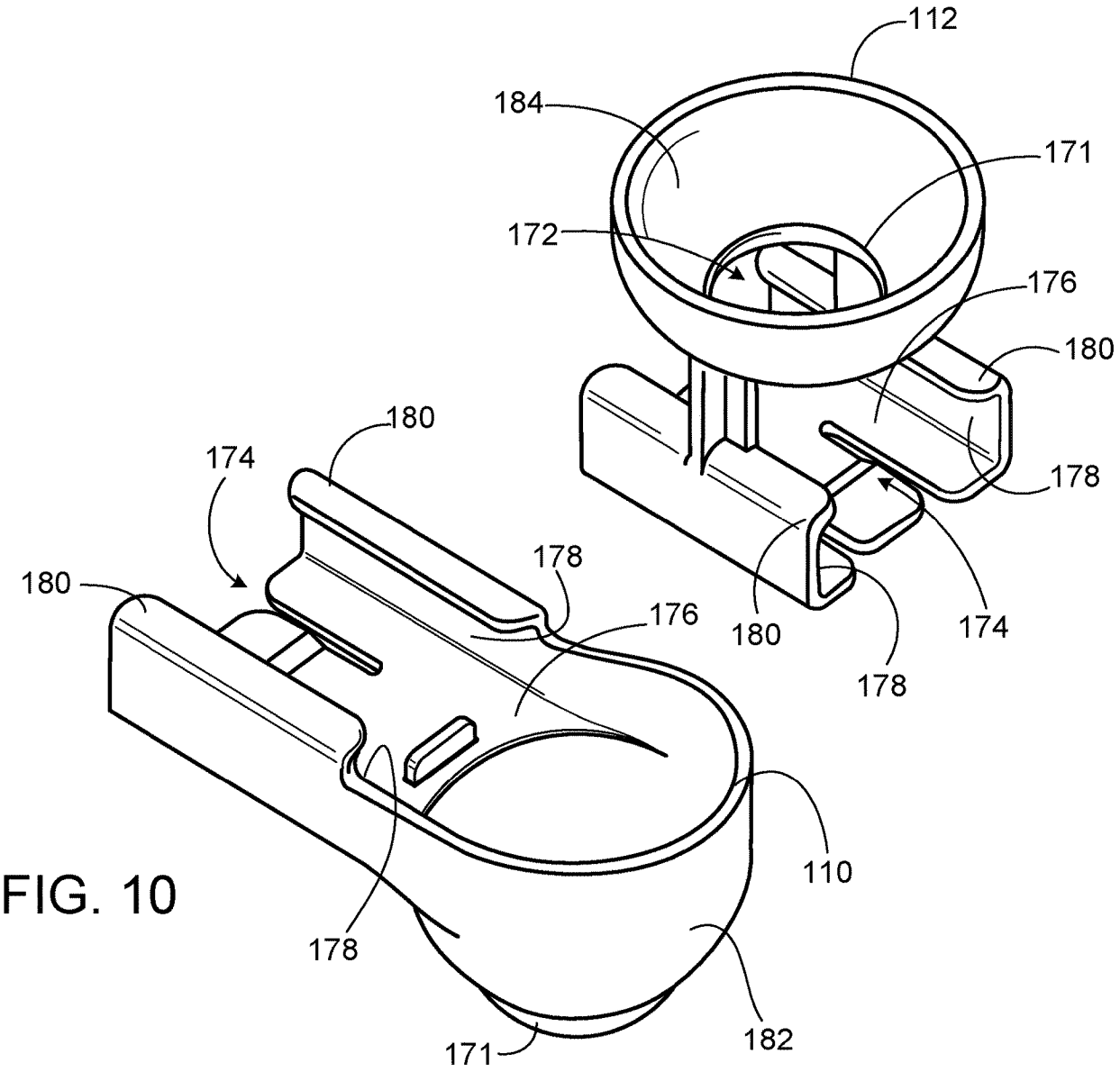
FIG. 10 is a perspective view of a first container attachment and a second container attachment.

Referring to FIG. 10, the toy construction set further includes a first container attachment 110 and a second container attachment 112 that are configured to releasably attach to an end of the elongated path segment or the winding path segment. The first and second container attachments 110, 112 are configured to the receive the ball and guide it to a next portion (e.g., another container or path segment) of the toy construction set. The first and second container attachments 110, 112 include concave, rounded, and nearly hemispherical first and second containers 182, 184, respectively, that are configured to receive the ball. Each of the first and second container attachments 110, 112 has a base 170 having a circular shape and defining an opening 172 configured to permit the ball to pass therethrough. The first container 182 has a depth that is greater than a depth of the second container 184. However, first and second containers attachments 110, 112 can include containers of any suitable size and shape.

Each of the first and second container attachments 110, 112 include a track 174 extending from the first and second containers 182, 184, respectively. The track 174 has a bottom surface 176, a pair of opposing side surfaces 178, and a pair of opposing side rails 180 extending from the pair of opposing side surfaces 178. The track 174 is configured to releasably receive the elongated path segment or the winding path segment. The elongated path segment or the winding path segment is configured to be slid within the track 174 such that the side, top, and bottom surfaces of the elongated path segment or the winding path segment contact the pair of opposing side surfaces 178, the pair of opposing side rails 180, and the bottom surface 176 of the track 174, respectively.

The bottom surface 176 of the track 174 of the first container attachment 110 has a projection 186 extending orthogonally upward, which is configured to stop the elongated path segment or the winding path segment, when received by the track 174, from extending into the cavity and/or opening of the first container 182.

Figure 11:
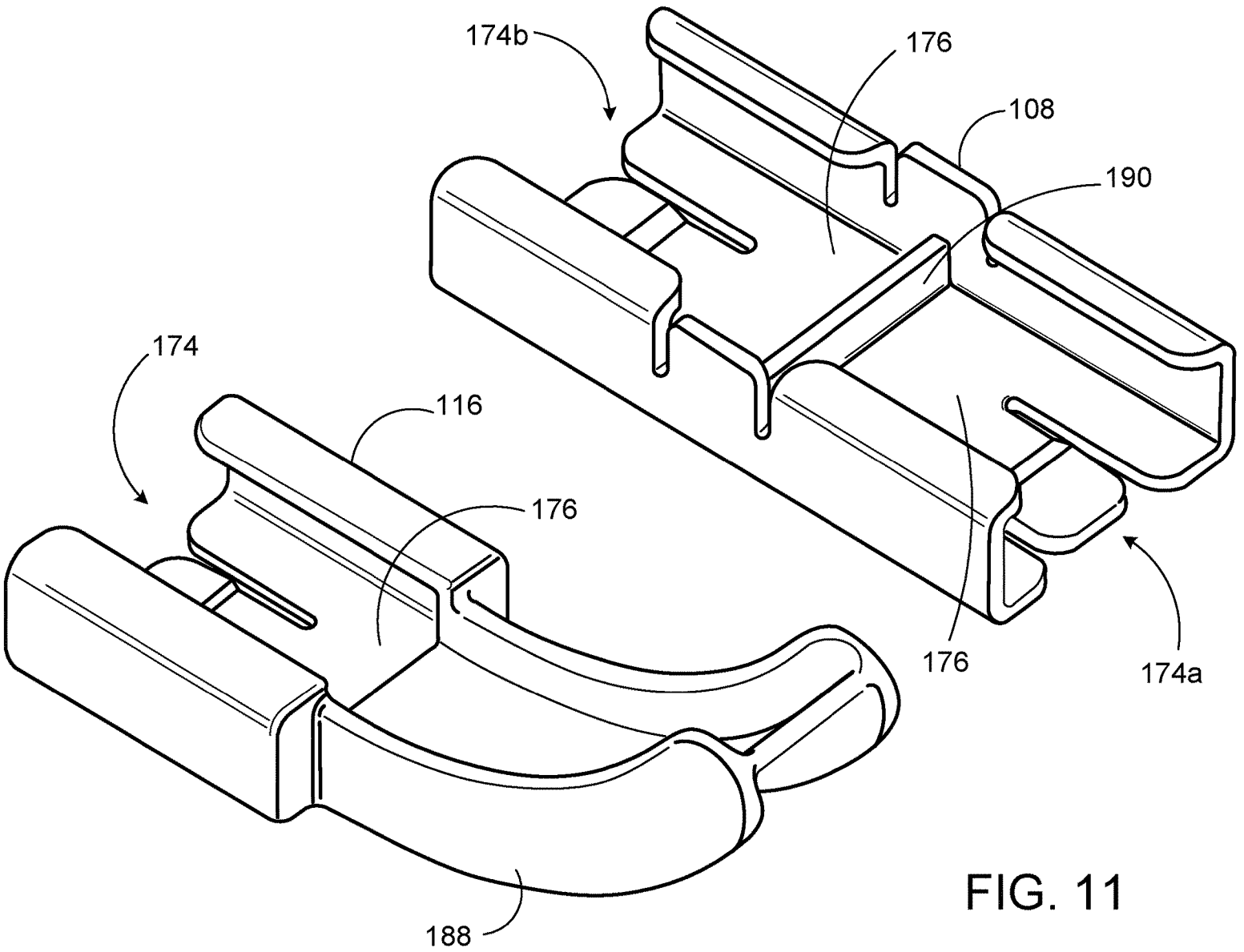
FIG. 11 is a perspective view of a curved path attachment and a connector.

Referring to FIG. 11, the toy construction set further includes a curved path attachment 116 and a connector 108 that are configured to releasably attach to an end of the elongated path segment or the winding path segment. The curved path attachment 116 includes a track 174 that is substantially similar in construction and function to the track 174 of the first and second container attachments 110, 112 described above. The curved path attachment 116 includes a curved path segment 188 that is integrally connected to the track 174. Thus, the curved path attachment 116 provides an extension of length to the ramp formed by one or more connected elongated path segments or winding path segments. The curved path segment 188 is angled or curved upward from a bottom surface of the track 174.

The connector 108 includes a first track 174*a* and a second track 174*b* that are substantially similar in construction and function to each other and to the track 174 of the first and second container attachments 110, 112 described above. The first and second tracks 174*a*, 174*b* are integrally connected and converge at a wall 190 extending upward, generally perpendicular from the bottom surface 176. The wall 190 is configured to stop the elongated path segment or the winding path segment (e.g., when received by a first track 174*a*) from extending too far into the opposing track 174 (e.g., the second track 174*b*). The connector 108 is configured to releasably couple two path segments (e.g., the elongated path segment to the winding path segment, two elongated path segments, or two winding path segments). The openings to the first and second tracks 174*a*, 174*b* face away from each other, along a length of the first and second tracks 174*a*, 174*b*. In some embodiments, the first track 174*a* forms is integrally connected to the second track 174*b* at a right angle.

While the above-discussed toy construction set 100 has been described and illustrated with respect to certain dimensions, shapes, arrangements, configurations, material formulations, and methods, in some embodiments, a toy construction that is otherwise substantially similar in construction and function to the toy construction set 100 may include one or more dimensions, shapes, arrangements, configurations, and/or materials formulations that are different from the ones discussed above or may be used with respect to methods that are modified as compared to the methods described above. For example, while the elevated path segment support 104 has been described and illustrated as including a groove 164 defined by the outer surface 152 of the legs 144 and configured to interact with and releasably couple to the ridge 162 extending outwardly or protruding from the inner surface 146 of each leg 144 of an additional elevated path segment support 104, in some embodiments, elevated path segment supports that are otherwise substantially similar in construction and function to the elevated path segment supports 104 may include a groove defined by the inner surface 146 of each leg 144 and a ridge extending outwardly or protruding from the outer surface 152 of the legs 144.

While a number of examples have been described for illustration purposes, the foregoing description is not intended to limit the scope of the invention, which is defined by the scope of the appended claims. There are and will be other examples and modifications within the scope of the following claims.

What is claimed is:

1. A toy construction set comprising:

an elongated path segment having side surfaces and an upper surface extending between the side surfaces, the elongated path segment having orthogonal overall dimensions of length, width and thickness, with the length being greater than the width, which is greater than the thickness, the width being a distance between the side surfaces;

an elevated path segment support having two spaced-apart legs with inner surfaces facing each other, and a shelf extending from the inner surfaces, the legs defining a space therebetween of sufficient width above the shelf to receive the elongated path segment therein, the shelf being configured to support the received elongated path segment in a locally elevated position with the elevated path segment support standing on its legs on a horizontal support surface, wherein the elevated path segment support further comprises a ridge extending outwardly from the inner surface of each leg in a region of each leg below the shelf; and a second elevated path segment support, wherein the elevated path segment support is a first elevated path segment support, and wherein the ridge of the first elevated path segment support is configured to connect with a groove of the second elevated path segment support such that the first elevated path segment support is stackable with the second elevated path segment support, wherein each leg of the elevated path segment support has an outer surface that is concave, wherein the outer surface of each leg defines a groove, and wherein the inner surfaces of the legs are convex in a region of each leg above the shelf, and wherein the inner surfaces of the legs are arranged with respect to the width of the elongated path segment such that rotating the elevated path segment support with respect to the elongated path segment with the elongated path segment received between the inner surfaces of the legs will cause the inner surfaces of the legs to bear against the side surfaces of the elongated path segment to brace the elongated path segment against the elevated path segment support within 30 degrees of elevated path segment support rotation from an orientation perpendicular to the elongated path segment.

2. The toy construction set of claim 1, wherein the elevated path segment support has a handle connecting the legs.

3. The toy construction set of claim 2, wherein the handle has a rounded, inverted U-shape.

4. The toy construction set of claim 1, wherein the elevated path segment support further comprises a wing extending outwardly from the inner surface of each leg in the region of each leg above the shelf.

5. The toy construction set of claim 1, further comprising a winding path segment configured to releasably couple to the elongated path segment via a connector.

6. The toy construction set of claim 5, further comprising one or more container attachments having a base defining an opening therethrough, the one or more container attachments configured to releasably couple to an end of the elongated path segment or an end of the winding path segment.

7. The toy construction set of claim 5, further comprising a curved path attachment configured to releasably couple to an end of the elongated path segment or an end of the winding path segment.

8. The toy construction set of claim 1, further comprising a toy configured to contact and travel on the upper surface of the elongated path segment.

9. The toy construction set of claim 8, wherein the toy is one or more of a ball, a marble, a toy vehicle, a disk, a toy wheel, or a ring.

10. A method of assembling a toy construction set, the method comprising:

stacking a first elevated path segment support onto a second elevated path segment support, each of the first and second elevated path segment supports having two spaced-apart legs with inner surfaces facing each other, and a shelf extending from the inner surfaces, wherein the stacking comprises connecting two first grooves, each of the grooves defined by an outer surface of each leg of the first elevated path segment support, to two second ridges extending outwardly from the inner surface of each leg of the second elevated path segment support;

inserting an elongated path segment above the shelf of the first or second elevated path segment supports, in a space of sufficient width defined between the legs such that a portion of the elongated path segment rests on the shelf; and rotating the first or second elevated path segment support that is supporting the elongated path segment with respect to the elongated path segment, thereby securing the elongated path segment.

11. The method of claim 10, wherein the elongated path segment has side surfaces and an upper surface extending between the side surfaces.

12. The method of claim 11, wherein the elongated path segment has orthogonal overall dimensions of length, width and thickness, with the length being greater than the width, which is greater than the thickness, the width being a distance between the side surfaces.

13. The method of claim 12, wherein securing the elongated path segment comprises receiving the elongated path segment between the inner surfaces of the legs, thereby causing the inner surfaces of the legs to bear against the side surfaces of the elongated path segment to brace the elongated path segment against the elevated path segment support.

14. The method of claim 13, wherein the elongated path segment braces the elongated path segment against the elevated path segment support within 30 degrees of elevated path segment support rotation from an orientation perpendicular to the elevated path segment support.

15. The method of claim 10, wherein the second ridges extending outwardly from the inner surface of each leg in a region of each leg below the shelf.

16. The method of claim 10, further comprising releasably coupling one or more of a winding path segment, a container attachment, or a curved path attachment to an end of the elongated path segment.

* * * * *